US009960504B2

(12) United States Patent
Hikosaka

(10) Patent No.: US 9,960,504 B2
(45) Date of Patent: May 1, 2018

(54) SHIELDED CONNECTOR

(71) Applicant: YAZAKI CORPORATION, Tokyo (JP)

(72) Inventor: Tomohiro Hikosaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/400,646

(22) Filed: Jan. 6, 2017

(65) Prior Publication Data

US 2017/0201034 A1 Jul. 13, 2017

(30) Foreign Application Priority Data

Jan. 12, 2016 (JP) ..... 2016-003334
Jul. 15, 2016 (JP) ..... 2016-140012

(51) Int. Cl.
*H01R 9/05* (2006.01)
*H01R 4/18* (2006.01)
*H01R 13/6473* (2011.01)

(52) U.S. Cl.
CPC ..... *H01R 9/0518* (2013.01); *H01R 4/18* (2013.01); *H01R 13/6473* (2013.01)

(58) Field of Classification Search
CPC ..... H01R 9/0518
USPC ..... 439/585
See application file for complete search history.

(56) References Cited

U.S. PATENT DOCUMENTS 3,670,293 A * 6/1972 Garver ..... H01R 9/0518 439/585
3,715,456 A * 2/1973 Faulkner ..... H01R 4/188 174/84 C
3,818,121 A * 6/1974 Hilton ..... H01R 4/2495 174/84 C
3,831,132 A * 8/1974 Bowden, Jr. ..... H01R 4/185 439/442
3,912,853 A * 10/1975 Wilkes ..... H01R 4/2495 174/84 C
4,922,058 A * 5/1990 Rodrigues ..... H01R 4/182 174/84 C
5,151,560 A * 9/1992 Kreinberg ..... H01R 4/64 174/78
6,098,443 A * 8/2000 Muller ..... H01R 4/184 29/753

(Continued)

FOREIGN PATENT DOCUMENTS

JP 2006-244816 A 9/2006

*Primary Examiner* — Tulsidas C Patel
*Assistant Examiner* — Peter G Leigh
(74) *Attorney, Agent, or Firm* — Kenealy Vaidya LLP

(57) ABSTRACT

A shielded connector includes a shielded cable, an inner terminal and an outer terminal. The shielded cable includes a conductor, an insulation cover covering the conductor, a shield layer covering the insulation cover, and an outermost insulation cover covering the shield layer. The inner terminal is connected to the conductor. The outer terminal houses the inner terminal and includes a shield crimping portion which is crimped on the shield layer. The shield crimping portion includes a pair of barrel pieces having end portions formed with an engagement projection and an engagement recess, respectively, that are engaged with each other so that the shield crimping portion is crimped on an exposed portion of the shield layer exposed from the outermost insulation cover so as to be a substantially true circle in cross section.

7 Claims, 14 Drawing Sheets

(56) References Cited

U.S. PATENT DOCUMENTS 6,384,335 B1 * 5/2002 Saito ..... H01R 9/0518 174/74 R
6,753,475 B2 * 6/2004 Takahashi ..... H01R 9/0518 174/75 C
6,951,483 B2 * 10/2005 Kameyama ..... H01R 9/0518 439/595
7,160,150 B2 * 1/2007 Annequin ..... H01R 43/048 439/585
7,291,043 B2 * 11/2007 Morikawa ..... H01R 9/05 439/578
7,316,581 B2 * 1/2008 Kumakura ..... H01R 4/182 439/422
7,318,742 B2 * 1/2008 Morikawa ..... H01R 9/0518 174/75 C
7,422,480 B1 * 9/2008 Musick ..... H01R 9/0518 439/585
7,479,033 B1 * 1/2009 Sykes ..... H01R 9/0518 439/578
7,562,449 B2 * 7/2009 Kuwayama ..... H01R 4/184 174/90
7,632,144 B2 * 12/2009 Sakaguchi ..... H01R 9/0518 439/585
7,635,282 B2 * 12/2009 Sakamoto ..... H01R 4/184 439/578
7,909,647 B2 * 3/2011 Kawaguchi ..... H01R 9/035 439/585
8,052,466 B2 * 11/2011 Okamoto ..... H01R 4/184 439/585
8,366,483 B2 * 2/2013 Hardy ..... H01R 9/0518 439/578
9,033,733 B2 * 5/2015 Takahashi ..... H01R 4/185 439/585
9,136,628 B2 * 9/2015 Aizawa ..... H01R 4/185
2005/0266727 A1 * 12/2005 Yamaguchi ..... H01R 9/0518 439/585
2011/0294344 A1 * 12/2011 Morikawa ..... H01R 4/185 439/585
2011/0318960 A1 * 12/2011 Koga ..... H01R 4/185 439/585
2013/0171873 A1 * 7/2013 Kanda ..... H01R 13/6581 439/607.51
2013/0280948 A1 * 10/2013 Tsuchida ..... H01R 13/62 439/372

* cited by examiner

SHIELDED CONNECTOR

CROSS REFERENCE TO RELATED APPLICATION

This application is based on Japanese Patent Application (No. 2016-003334) filed on Jan. 12, 2016 and Japanese Patent Application (No. 2016-140012) filed on Jul. 15, 2016, the contents of which are incorporated herein by reference. Also, all the references cited herein are incorporated as a whole.

BACKGROUND

1. Technical Field

The present invention relates to a shielded connector in which an outer terminal has a shield crimping portion to be crimped onto a shield layer of a shielded cable.

2. Background Art

Conventionally, to transmit radio-frequency electrical signals, shielded cables applicable to radio-frequency uses are used in control units of various kinds of electrical equipment installed in automobiles etc., such as car navigation devices.

Shielded cables have a structure that the outer circumferential surface of an insulation cover that covers the outer circumferential surface of a conductor made of a conductive material is covered with a shield layer. Transmission of radio-frequency electrical signals is enabled because the outside shield layer shuts out external electrical influences.

Shielded connectors are used for electrical connection of shielded cables. Shielded connectors are composed of a shielded cable in which the outer circumferential surface of an insulation cover that covers the outer circumferential surface of a conductor is covered with a shield layer, an inner terminal connected to the conductor, and an outer terminal which houses the inner terminal and has a shield crimping portion crimped on the shield layer.

For example, JP-A-2006-244816 discloses a shielded cable-terminal metal fitting attachment structure in which a barrel of an outer terminal is crimped on a portion, folded onto the outer surface of an end portion of an outer sheath of a shielded cable, of a shield layer and the end portion of the outer sheath.

However, in the shielded cable-terminal metal fitting attachment structure disclosed in JP-A-2006-244816, since the barrel of the outer terminal is crimped onto the outer circumferential surface of the portion of the shield layer in such a manner that end portions of the barrel are laid on each other, the portion, inside the crimped barrel, of the shielded cable is prone to assume a deformed circle in cross section. This means a problem that the radial distance between the core wire (conductor) and the shield layer is made non-uniform, resulting in disorder in impedance.

SUMMARY

The present invention has been made in view of the above circumstances, and an object of the invention is therefore to provide a shielded connector capable of preventing the phenomenon that the radial distance between the conductor and the shield layer is made non-uniform to cause disorder in impedance.

To solve the above problem and attain the above object, there is provided a shielded connector shielded connector including:

a shielded cable including:

a conductor;

an insulation cover that covers an outer circumferential surface of the conductor;

a shield layer that covers an outer circumferential surface of the insulation cover; and an outermost insulation cover that covers an outer circumferential surface of the shield layer, an inner terminal connected to the conductor; and an outer terminal that houses the inner terminal and includes a shield crimping portion which is crimped on the shield layer, wherein the shielded cable is a coaxial cable; and wherein the shield crimping portion includes a pair of barrel pieces having end portions formed with an engagement projection and an engagement recess, respectively, that are engaged with each other so that the shield crimping portion is crimped on an outer circumferential surface of an exposed portion of the shield layer exposed from the outermost insulation cover so as to be a substantially true circle in cross section.

DETAILED DESCRIPTION OF THE EXEMPLARY EMBODIMENTS

Shielded connectors according to preferred embodiments of the present invention will be hereinafter described in detail with reference to the drawings.

Embodiment 1

Figure 1:
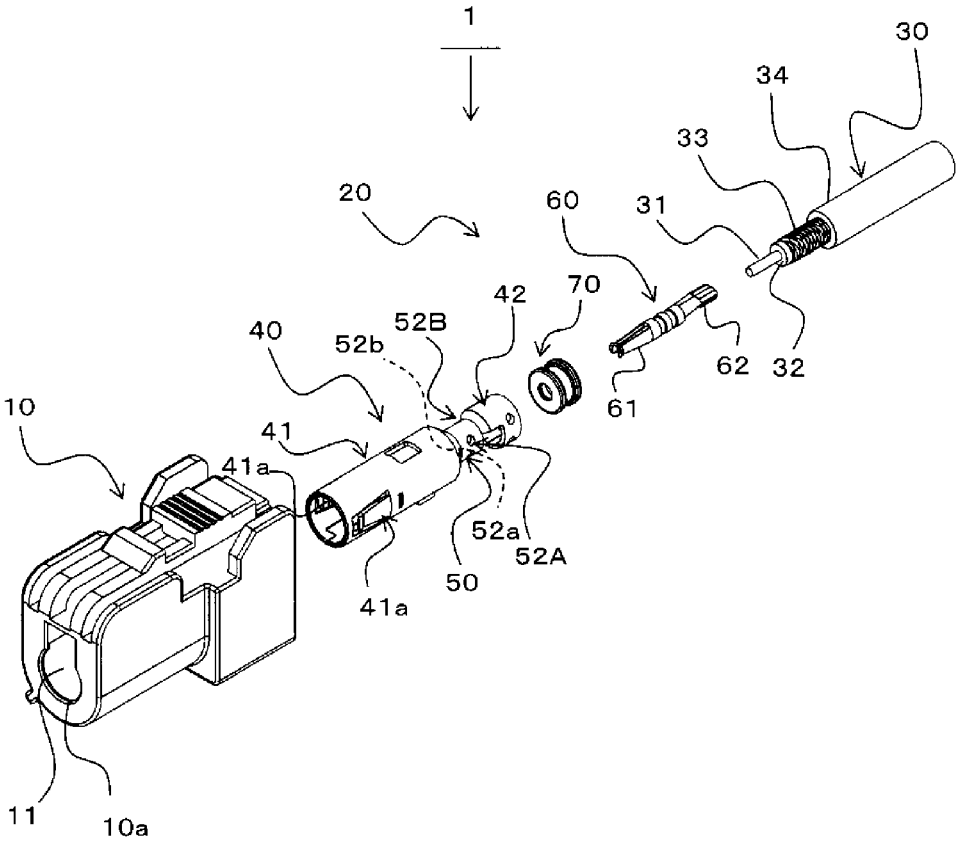
FIG. 1 is an exploded perspective view of a shielded connector according to a first embodiment of the present invention.
Figure 2:
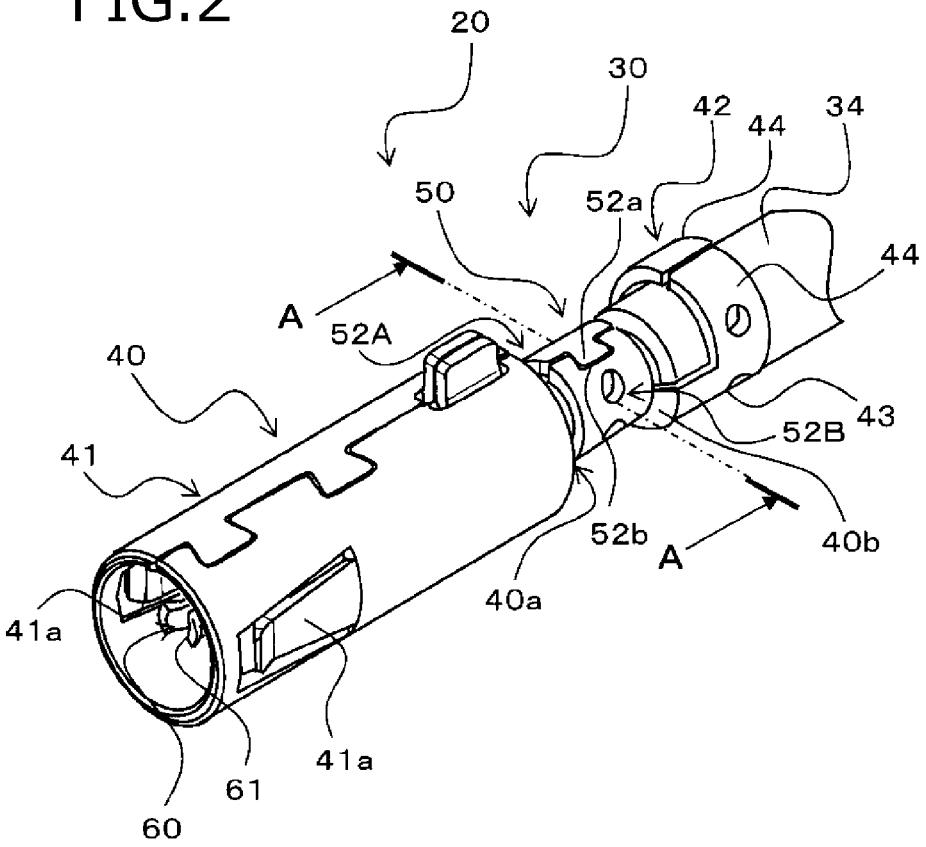
FIG. 2 is a perspective view of a terminal-equipped cable shown in FIG. 1.
Figure 3:
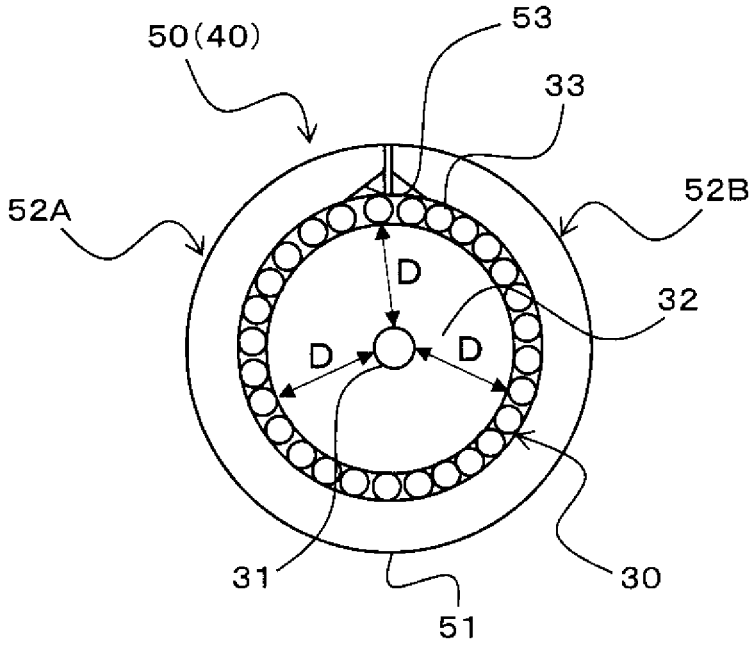
FIG. 3 is a sectional view, taken along line A-A in FIG. 2, of the terminal-equipped cable.
Figure 4:
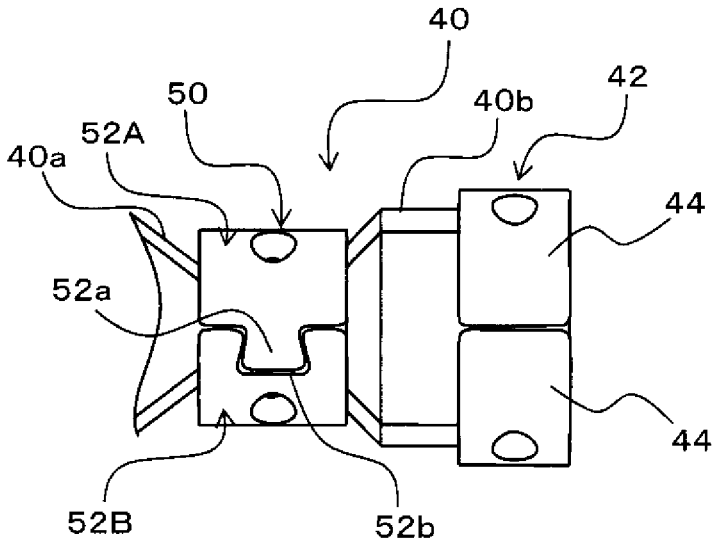
FIG. 4 is a top view of a shield crimping portion and its neighborhood of an outer terminal.
Figure 5:
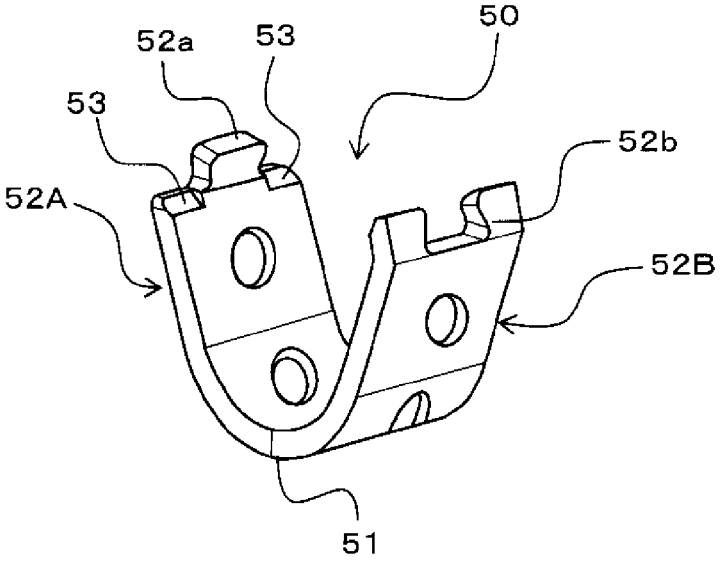
FIG. 5 is a perspective view of only the shield crimping portion, before crimping, of the outer terminal.
Figure 6:
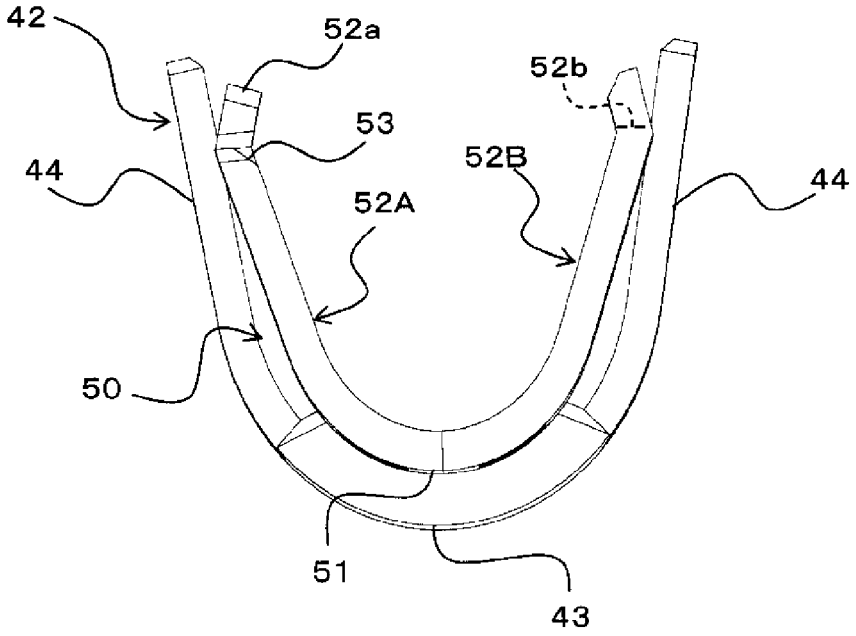
FIG. 6 is a view, as viewed in the extension direction of a shielded cable, of the shield crimping portion and an insulation cover crimping portion, before crimping, of the outer terminal.
Figure 7:
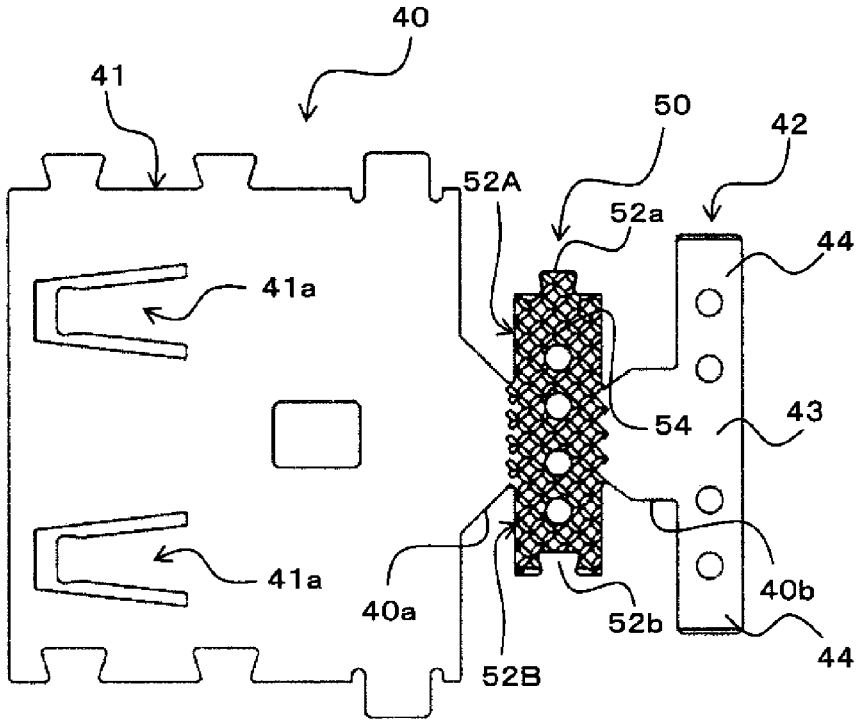
FIG. 7 is a development view of the outer terminal.
Figure 8A:
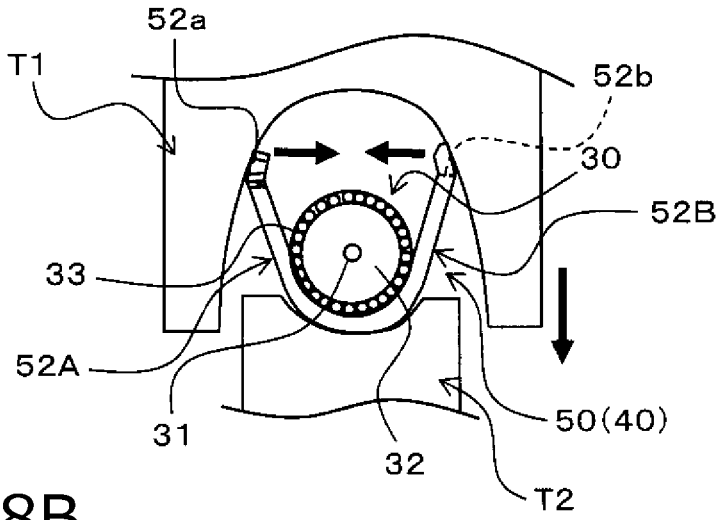
FIGS. 8A and 8B illustrate how the shield crimping portion is crimped onto a shield layer by means of a top die and a bottom die.
Figure 8B:
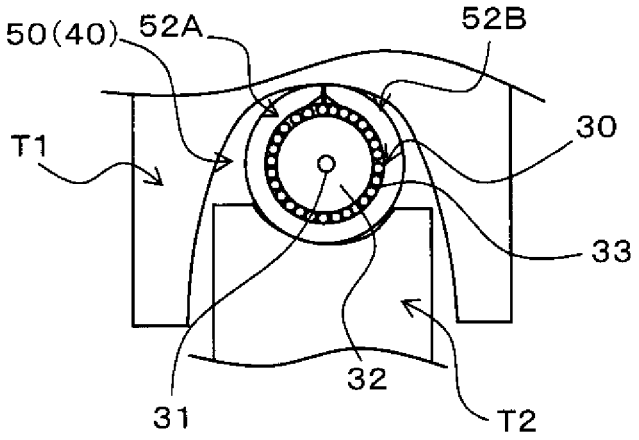

FIG. 1 is an exploded perspective view of a shielded connector 1 according to a first embodiment of the invention. FIG. 2 is a perspective view of a terminal-equipped cable 20 shown in FIG. 1. FIG. 3 is a sectional view, taken along line A-A in FIG. 2, of the terminal-equipped cable 20. FIG. 4 is a top view of a shield crimping portion 50 and its neighborhood of an outer terminal 40. FIG. 5 is a perspective view of only the shield crimping portion 50, before crimping, of the outer terminal 40. FIG. 6 is a view, as viewed in the extension direction of a shielded cable 30, of the shield crimping portion 50 and an insulation cover crimping portion 42, before crimping, of the outer terminal 40. FIG. 7 is a development view of the outer terminal 40. FIGS. 8A and 8B illustrate how the shield crimping portion 50 is crimped onto a shield layer 33 by means of a top die T1 and a bottom die T2.

The shielded connector 1 according to the first embodiment serves to transmit a radio-frequency electrical signal by electrically connecting a shielded cable to a control unit of an electrical device installed in an automobile or the like.

The shielded connector 1 is composed of a connector housing 10 and the terminal-equipped cable 20 whose outer terminal 40 is housed in the connector housing 10.

First, the connector housing 10 will be described. The connector housing 10 is made of an insulative material such as a synthetic resin and is formed so as to house the outer terminal 40 in a space 11 which penetrate through the connector housing 10 in the front-rear direction.

An inner terminal 60 is disposed inside the outer terminal 40 which is housed in the thus-formed connector housing 10. The inner terminal 60 is to be electrically connected to a counterpart connection terminal (not shown) that is inserted in the space 11 through a front opening 10*a* of the connector housing 10.

Next, the terminal-equipped cable 20 will be described. The terminal-equipped cable 20 is composed of the shielded cable 30, the outer terminal 40, the inner terminal 60, and a dielectric member 70.

The shielded cable 30 is a coaxial cable in which the outer circumferential surface of an insulation cover 32 which covers the outer circumferential surface of a conductor 31 is covered with a shield layer 33 and the outer circumferential surface of the shield layer 33 is covered with an outermost insulation cover 34.

More specifically, in the shielded cable 30, the outer circumferential surface of the conductor 31 which is a single core wire is covered with the insulation cover 32, the outer circumferential surface of the insulation cover 32 is covered with the shield layer 33 which is a wire braid, and the outer circumferential surface of the shield layer 33 is covered with the outermost insulation cover 34.

The inner terminal 60 is crimped on the outer circumferential surface of a tip portion, exposed by peeling off the outermost insulation cover 34, the shield layer 33, and the insulation cover 32 by respective prescribed lengths, of the conductor 31. Furthermore, the outer terminal 40 is crimped on the outer circumferential surface of a portion, adjacent to the exposed tip portion of the conductor 31 and exposed by peeling off the outermost insulation cover 34 by a prescribed length, of the shield layer 33.

That is, in the shielded cable 30, the exposed portion of the conductor 31 and the exposed portion of the shield layer 33 having respective prescribed lengths are arranged in this order in the axial direction from the tip of the shielded cable 30. And the inner terminal 60 and the outer terminal 40 are crimped on the exposed portion of the conductor 31 and the exposed portion of the shield layer 33, respectively.

Although in the first embodiment the conductor 31 is a single core wire, this aspect of the invention is not limited to this case. Another type of conductor 31 such as a wire formed by twining plural element wires may be used as long as the shielded cable 30 is a coaxial cable.

The outer terminal 40, which is a terminal to be connected to the shield layer 33, is a terminal having a prescribed shape formed by, for example, pressing a plate-like metal member. More specifically, as shown in FIG. 7 which is a development view, a plate-like metal member is subjected to punching and a resulting member is subjected to bending etc. so as to be given the prescribed shape.

The outer terminal 40 has an outer terminal main body 41 to house the inner terminal 60, the shield crimping portion 50 to be crimped onto the shield layer 33, and an insulation cover crimping portion 42 to be crimped onto the outermost insulation cover 34.

The outer terminal main body 41 is approximately cylindrical, and the inner terminal 60 is locked on the outer terminal main body 41 from inside at a prescribed position by a locking structure (not shown). The outer terminal main body 41 is inserted in the connector housing 10 and locked on it at a prescribed position by a locking structure (not shown). The outer terminal main body 41 is formed with a pair of elastic lock pieces 41*a*.

A bottom wall 51 of the shield crimping portion 50 is linked to a bottom wall of the outer terminal main body 41 by a link portion 40*a* which is continuous with the bottom wall of the outer terminal main body 41, and a pair of barrel pieces 52A and 52B are erected from the bottom wall 51 on both sides.

The pair of barrel pieces 52A and 52B are formed with an engagement projection 52*a* and an engagement recess 52*b* to be engaged with each other so that the shield crimping portion 50 is crimped onto the outer circumferential surface of the portion, exposed by peeling off the corresponding portion of the outermost insulation cover 34, of the shield layer 33 so as to approximately assume a true circle.

The engagement projection 52*a* increases in width as the position goes from its base side to its tip side in the projection direction, and the engagement recess 52*b* is shaped so as to conform to, that is, to fit with, the engagement projection 52*a*.

The longitudinal lengths of the pair of barrel pieces 52A and 52B are adjusted so that the shield crimping portion 50 as a whole can surround, in true circle form, the outer circumferential surface of the shield layer 33 in a state that the engagement projection 52*a* and the engagement recess 52*b* are engaged with each other.

As shown in FIGS. 5 and 6, before being crimped onto the shield layer 33, the shield crimping portion 50 is approximately U-shaped. And the engagement projection 52*a* of the barrel piece 52A and the end portion formed with the engagement recess 52*b* of the barrel piece 52B are bent inward, which allows the end portions of the pair of barrel pieces 52A and 52B to come close to each other to establish a state that the shield crimping portion 50 can be deformed into a circular shape easily at an initial stage of crimping.

The bend angles of the end portions of the pair of barrel pieces 52A and 52B are adjusted so that when bent sliding on an arch-shaped curved surface of a top die T1 (see FIG. 8), the engagement projection 52*a* and the end portion formed with the engagement recess 52*b* are located at such positions that the engagement projection 52*a* and the engagement recess 52*b* can engage with each other easily.

In the shield crimping portion 50, inner edges located on the two respective sides of the base portion of the engagement projection 52*a* are cut to form engagement guide slant surfaces 53 as guides for engagement between the engagement projection 52*a* and the engagement recess 52*b*, the engagement guide slant surfaces 53 being inclined in such a manner that the barrel piece 52A becomes thinner as the position goes toward its tip.

The engagement guide slant surfaces 53 also have a function of guiding the tip surfaces of the end portion formed with the engagement recess 52*b* of the barrel piece 52B as the tip surfaces slide on the engagement guide slant surfaces 53 after touching them (the end portion formed with the engagement recess 52*b* of the barrel piece 52B is bent), whereby the engagement recess 52*b* is registered with the engagement projection 52*a* below it.

That is, the engagement guide slant surfaces 53 have the guiding function for facilitating engagement between the engagement projection 52*a* and the engagement recess 52*b* and the guiding function for allowing the shield crimping portion 50 to be bent so as to assume a true circle shape.

As shown in FIG. 7, the inner surface, that is, the surface to be brought into contact with the shield layer 33 at the time of crimping, of the shield crimping portion 50 is formed with asperities 54 (projections and recesses). When the shield crimping portion 50 is crimped onto the outer circumferential surface of the shield layer 33, the asperities 54 dig into the shield layer 33, whereby the shield crimping portion 50 comes into close and tight contact with the shield layer 33.

As shown in FIGS. 8A and 8B, the shield crimping portion 50 having the above structure is crimped onto the outer circumferential surface of the shield layer 33 so as to assume a true circle by closing the top die T1 and the bottom die T2. As a result, as shown in FIG. 3, the distance D between the shield layer 33 and the conductor 31 of the shielded cable 30 which is a coaxial cable can be made uniform.

The shield crimping portion 50 is crimped onto the outer circumferential surface of the portion, exposed by peeling off the corresponding portion of the outermost insulation cover 34, of the shield layer 33 rather than a portion, folded onto the outer circumferential surface of the outermost insulation cover 34, of the shield layer 33. This removes one factor in making the distance between the conductor 31 and the shield layer 33 non-uniform, such as wrinkles of the shield layer 33 formed by folding it.

A bottom wall 43 of the insulation cover crimping portion 42 is linked to the shield crimping portion 50 by a link portion 40*b* which is continuous with the bottom wall 51 of the shield crimping portion 50. As shown in FIG. 6, a pair of barrel pieces 44 are erected from the bottom wall 43 on both sides.

The insulation cover crimping portion 42 having the above structure is linked to the shield crimping portion 50 by the link portion 40*b*, and is thereby crimped onto the outermost insulation cover 34 at a position that is distant from the shield crimping portion 50. That is, the shield crimping portion 50 is crimped onto the shield layer 33 independently of the insulation cover crimping portion 42. As a result, the shield crimping portion 50 is not prone to be affected by deformation that occurs when the insulation cover crimping portion 42 is crimped onto the outermost insulation cover 34.

The inner terminal 60 has an approximately cylindrical counterpart terminal connection portion 61 to be connected to a counterpart connection terminal (not shown) and a crimping portion 62 to be crimped onto the exposed portion of the conductor 31.

The dielectric member 70 has a specific dielectric constant and is interposed between the outer terminal 40 and the inner terminal 60. The dielectric member 70, which is approximately cylindrical and is made of an insulative material, is press-fitted with the inner terminal 60 housed inside and is disposed inside the outer terminal main body 41, whereby the dielectric member 70 can support, inside the outer terminal main body 41, the inner terminal 60 in a state that it is insulated from the outer terminal 40.

The shielded connector 1 having the above configuration is completed by completing a terminal-equipped cable 20 by exposing portions of the conductor 31 and the shield layer 33 by respective prescribed lengths so that they are arranged in this order in the axial direction from the tip of the shielded cable 30, crimping the crimping portion 62 of the inner terminal 60 onto the exposed portion of the conductor 31, disposing, inside the outer terminal main body 41, the inner terminal 60 that is press-fitted in the dielectric member 70, crimping the shield crimping portion 50 of the outer terminal 40 onto the exposed portion of the shield layer 33, and crimping the insulation cover crimping portion 42 onto the outermost insulation cover 34, and then housing the outer terminal 40 of the thus-completed terminal-equipped cable 20 in the connector housing 10.

Next, referring to FIGS. 9A-9D and FIGS. 10A-10D, a detailed description will be made of how the shield crimping portion 50 is crimped onto the outer circumference of the exposed portion of the shield layer 33.

Figure 9A:
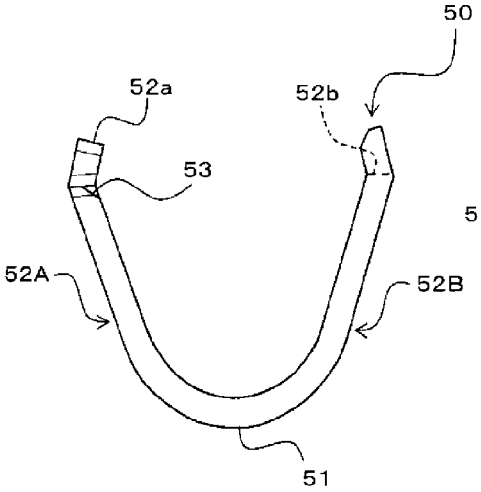
FIG. 9A is a view, as viewed in the extension direction of the shielded cable, of the shield crimping portion before a start of crimping.
Figure 9B:
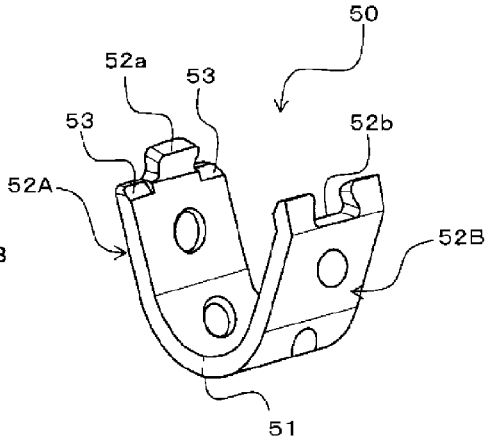
FIG. 9B is a perspective view corresponding to FIG. 9A.
Figure 9C:
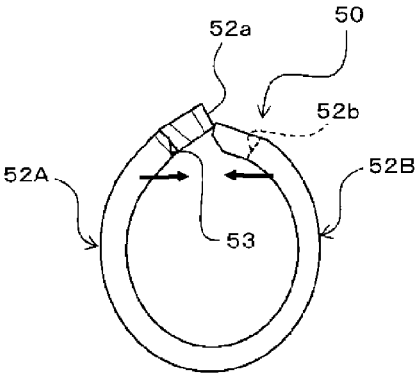
FIG. 9C is a view, as viewed in the extension direction of the shielded cable, showing a state that crimping of the shield crimping portion onto the shield layer has started and respective end portions of a pair of barrel pieces have come closer to each other.
Figure 9D:
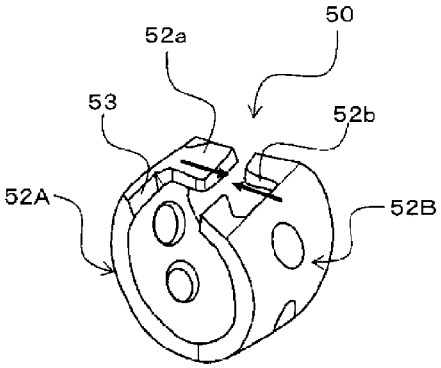
FIG. 9D is a perspective view corresponding to FIG. 9C.

FIG. 9A is a view, as viewed in the extension direction of the shielded cable 30, of the shield crimping portion 50 before a start of crimping, FIG. 9B is a perspective view corresponding to FIG. 9A, FIG. 9C is a view, as viewed in the extension direction of the shielded cable 30, showing a state that crimping of the shield crimping portion 50 onto the shield layer 33 has started and the end portions of the pair of barrel pieces 52A and 52B have come closer to each other, and FIG. 9D is a perspective view corresponding to FIG. 9C.

Figure 10A:
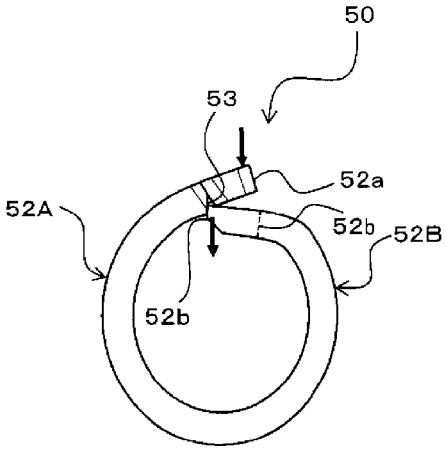
FIG. 10A is a view, as viewed in the extension direction of the shielded cable, showing a state that the shield crimping portion has been deformed further to cause crimping onto the shield layer and been bent so as to assume a shape that is close to a circle.
Figure 10B:
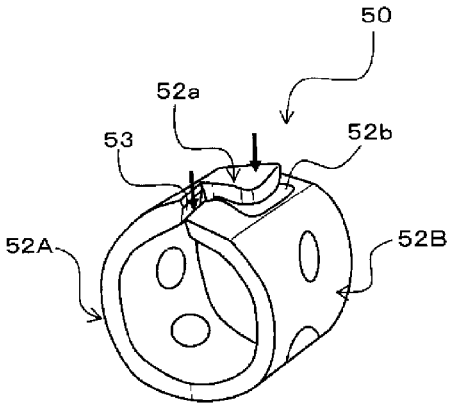
FIG. 10B is a perspective view corresponding to FIG. 10A.
Figure 10C:
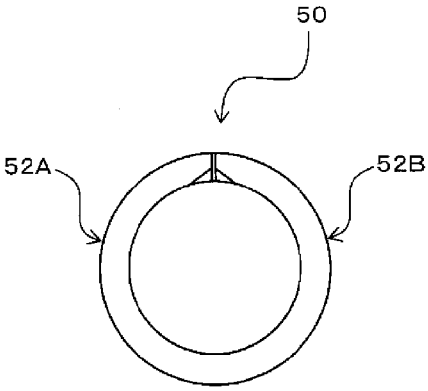
FIG. 10C is a view, as viewed in the extension direction of the shielded cable, showing a state that the shield crimping portion has been crimped onto the shield layer completely.
Figure 10D:
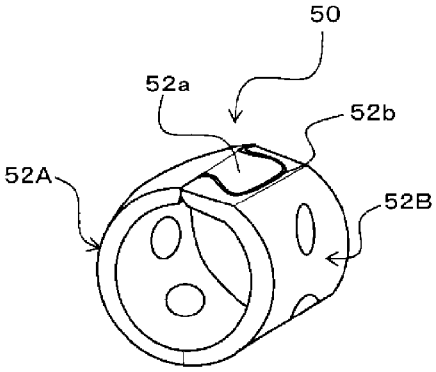
FIG. 10D is a perspective view corresponding to FIG. 10C.

FIG. 10A is a view, as viewed in the extension direction of the shielded cable 30, showing a state that the shield crimping portion 50 has been deformed further to cause crimping onto the shield layer 33 and been bent so as to assume a shape that is close to a circle, FIG. 10B is a perspective view corresponding to FIG. 10A, FIG. 10C is a view, as viewed in the extension direction of the shielded cable 30, showing a state that the shield crimping portion 50 has been crimped onto the shield layer 33 completely, and FIG. 10D is a perspective view corresponding to FIG. 10C. FIGS. 9A-9D and FIGS. 10A-10D show only the shield crimping portion 50.

In a state before a start of crimping of the shield crimping portion 50 onto the shield layer 33, as shown in FIGS. 9A and 9B, the shield crimping portion 50 is approximately U-shaped and the engagement projection 52*a* of the barrel piece 52A and the end portion formed with the engagement recess 52*b* of the barrel piece 52B are bent inward.

When crimping of the shield crimping portion 50 onto the shield layer 33 using the top die T1 and the bottom die T2 (see FIG. 8) is started from the state shown in FIGS. 9A and 9B, as shown in FIGS. 9C and 9D the pair of barrel pieces 52A and 52B are bent so that their end portions come closer to each other.

The reason why the end portions of the pair of barrel pieces 52A and 52B can come closer to each other at an initial stage of crimping is that the engagement projection 52*a* of the barrel piece 52A and the end portion formed with the engagement recess 52*b* of the barrel piece 52B are bent inward before the start of the crimping.

When the crimping of the shield crimping portion 50 onto the shield layer 33 has proceeded further, as shown in FIGS. 10A and 10B, the tip surfaces of the end portion formed with the engagement recess 52*b* of the barrel piece 52B are guided by the respective engagement guide slant surfaces 53 while sliding thereon, whereby the engagement recess 52*b* is registered with the engagement projection 52*a* below it. In this manner, the shield crimping portion 50 is bent so as to assume an approximately circular shape.

When the shield crimping portion 50 has been crimped onto the shield layer 33 completely, as shown in FIGS. 10C and 10D, the shield crimping portion 50 assumes a true circle in a state that the engagement projection 52*a* and the engagement recess 52*b* are completely engaged with each other and the end portions of the pair of barrel pieces 52A and 52B are connected to each other completely. The shield crimping portion 50 finally assumes a true circle when the top die T1 and the bottom die T2 are closed completely.

In the shielded connector 1 according to the first embodiment, the shielded cable 30 is a coaxial cable and the shield crimping portion 50 is crimped on the outer circumferential surface of a portion, exposed by peeling off a corresponding portion of the outermost insulation cover 34, of the shielded cable 30 by engaging the engagement projection 52*a* of the barrel piece 52A with the engagement recess 52*b* of the barrel piece 52B. In this manner, the shield crimping portion 50 can be crimped onto the shield layer 33 which extends parallel with the circular outer circumferential surface of the insulation cover 32 in such a manner that the shield crimping portion 50 assumes a true circle because of the engagement between the engagement projection 52*a* and the engagement recess 52*b*. Thus, the radial distance between the conductor 31 and the shield layer 33 is made uniform, which prevents impedance disorder due to non-uniformity in the radial distance between the conductor 31 and the shield layer 33.

In the shielded connector 1 according to the first embodiment, since the shield crimping portion 50 and the insulation cover crimping portion 42 can be crimped so to be spaced from each other, crimping deformation of the insulation cover crimping portion 42 does not affect the shield crimping portion 50. This is also a factor in allowing the shield crimping portion 50 to be crimped onto the shield layer 33 so as to assume a shape that is close to a true circle.

In the shielded connector 1 according to the first embodiment, the width of the engagement projection 52*a* varies in simple form and the engagement recess 52*b* is formed so as to conform to the engagement projection 52*a*. Thus, the engagement projection 52*a* and the engagement recess 52*b* can be engaged with each other easily and strongly.

In the shielded connector 1 according to the first embodiment, before the shield crimping portion 50 is crimped onto the shield layer 33, the shield crimping portion 50 is approximately U-shaped and the engagement projection 52*a* of the barrel piece 52A and the end portion formed with the engagement recess 52*b* of the barrel piece 52B are bent inward. Thus, at an initial stage of crimping, the end portions of the pair of barrel pieces 52A and 52B can be made close to each other to establish a state that the shield crimping portion 50 can be deformed so as to assume a circular shape. This makes it easier for the shield crimping portion 50 to be crimped so as to assume a true circle.

In the shielded connector 1 according to the first embodiment, since the shield crimping portion 50 is formed with the engagement guide slant surfaces 53, in a process of crimping of the shield crimping portion 50 onto the shield layer 33, the tip surfaces of the end portion formed with the engagement recess 52*b* of the barrel piece 52B are guided by the respective engagement guide slant surfaces 53 while sliding thereon, whereby the engagement recess 52*b* is registered with the engagement projection 52*a* below it. In this manner, the shield crimping portion 50 tends to be bent so as to assume a circular shape. This makes it easier for the shield crimping portion 50 to be crimped so as to assume a true circle.

Embodiment 2

Next, a shielded connector 2 according to a second embodiment of the invention will be described with reference to FIGS. 11A and 11B to FIG. 14.

Figure 11A:
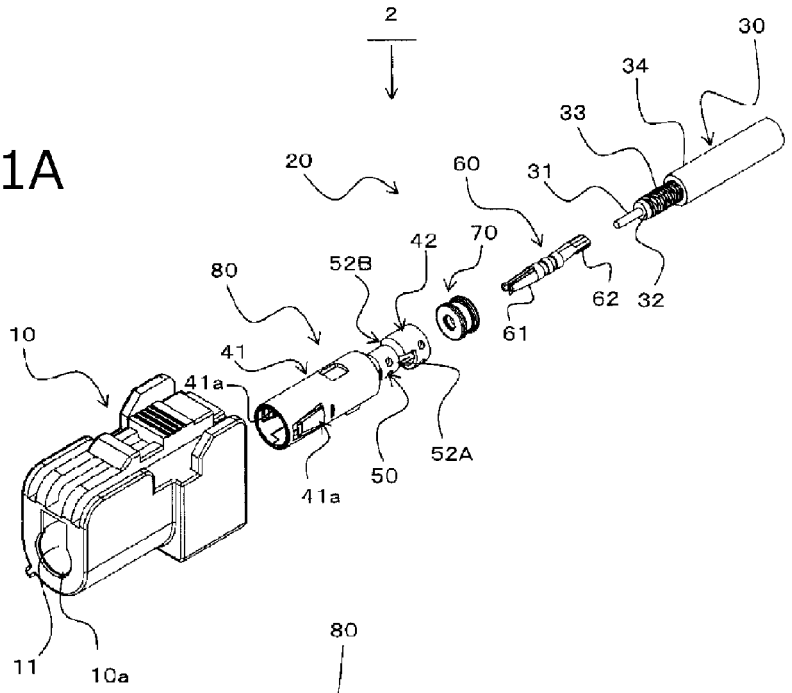
FIG. 11A is an exploded perspective view of the shielded connector according to a second embodiment of the invention.
Figure 11B:
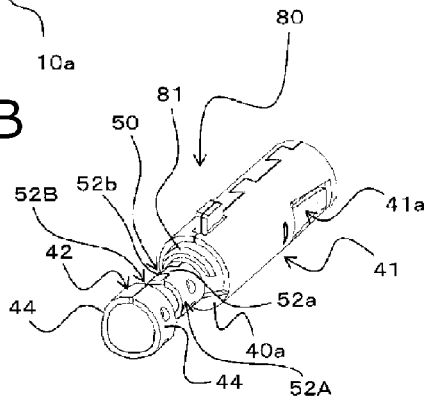
FIG. 11B is a perspective view of an outer terminal shown in FIG. 11A as viewed from the side of an insulation cover crimping portion.
Figure 12:
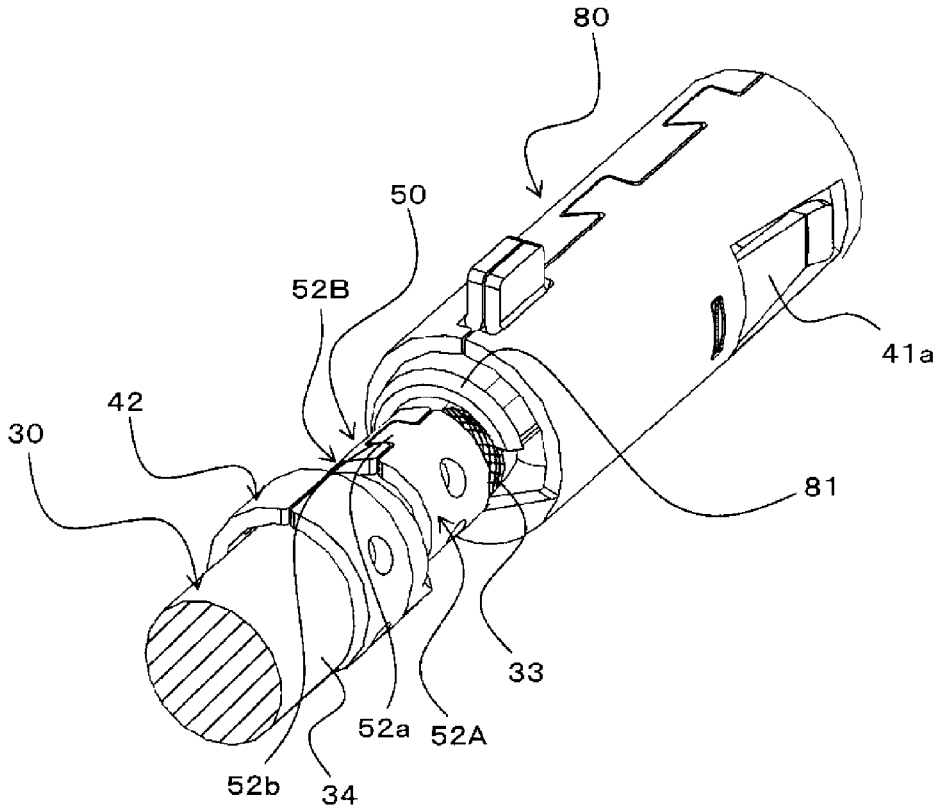
FIG. 12 is a perspective view of a shielded cable to which the outer terminal is attached completely.
Figure 13:
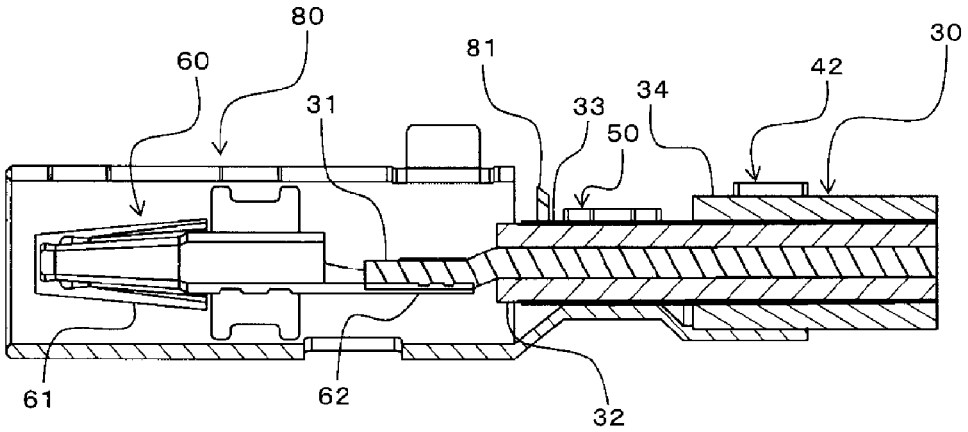
FIG. 13 is a sectional view of the shielded cable to which the outer terminal is attached completely.
Figure 14:
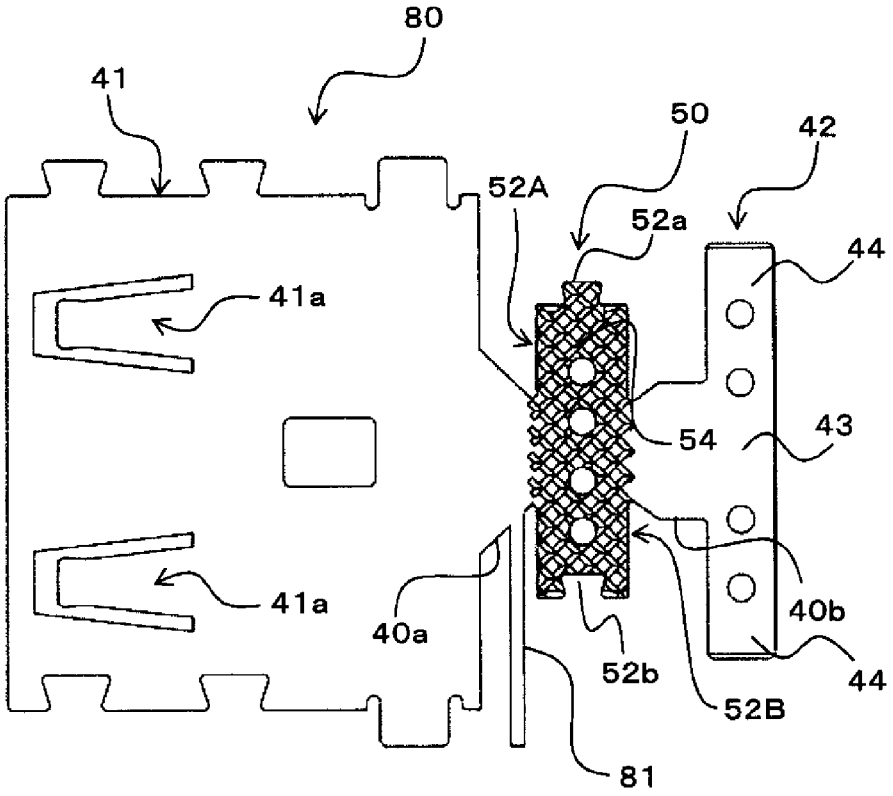
FIG. 14 is a development view of the outer terminal.

FIG. 11A is an exploded perspective view of the shielded connector 2 according to the second embodiment, and FIG. 11B is a perspective view of an outer terminal 80 as viewed from the side of an insulation cover crimping portion 42. FIG. 12 is a perspective view of a shielded cable 30 to which the outer terminal 80 is attached completely. FIG. 13 is a sectional view of the shielded cable 30 to which the outer terminal 80 is attached completely. FIG. 14 is a development view of the outer terminal 80.

The shielded connector 2 according to the second embodiment is different from the shielded connector 1 according to the first embodiment in that the outer terminal 80 of the former further has a braid disintegration preventive band portion 81. The other part of the configuration of the shielded connector 2 is the same as that of the shielded connector 1, and constituent elements of the former having the same ones in the latter will be given the same reference symbols as the latter and descriptions therefor will be omitted.

The outer terminal 80, which is a terminal to be connected to a shield layer 33, is a terminal having a prescribed shape formed by, for example, pressing a plate-like metal member. More specifically, as shown in FIG. 14 which is a development view, a plate-like metal member is subjected to punching and a resulting member is subjected to bending etc. so as to be given the prescribed shape.

The outer terminal 80 has an outer terminal main body 41 to house the inner terminal 60, a shield crimping portion 50 to be crimped onto the shield layer 33, an insulation cover crimping portion 42 to be crimped onto the outermost insulation cover 34, and the braid disintegration preventive band portion 81.

The braid disintegration preventive band portion 81 is formed in front of the shield crimping portion 50 in the extension direction of the shielded cable 30, and serves to cover the shield layer 33 by extending parallel with its outer circumferential surface.

The braid disintegration preventive band portion 81 projects from the link portion 40*a* which links the bottom wall of the outer terminal main body 41 and the bottom wall 51 of the shield crimping portion 50. More specifically, the braid disintegration preventive band portion 81 projects like a band from an edge of the link portion 40*a* at a position that is deviated toward the shield crimping portion 50 from a position where the tip of the shield layer 33 is to be placed.

As shown in FIG. 14 which is a development view, before being bent so as to become parallel with the outer circumferential surface of the shield layer 33, the braid disintegration preventive band portion 81 projects from the link portion 40*a* parallel with the projection direction of the barrel pieces 52A and 52B in a developed state, that is, approximately perpendicularly to the extension direction of the shielded cable 30.

The braid disintegration preventive band portion 81 is bent from the developed state shown in FIG. 14 by a die (not shown) so as to cover the shield layer 33 by extending parallel with its outer circumferential surface (see FIG. 12).

As a result, the braid disintegration preventive band portion 81 covers an exposed tip portion, sticking out of the shield crimping portion 50 on the front side of it in the extension direction of the shielded cable 30, of the shield layer 33 by extending parallel with its outer circumferential surface.

The braid disintegration preventive band portion 81 covers the shield layer 33 around the same circumferential region as the circumferential region where the engagement projection 52*a* of the barrel piece 52A and the engagement recess 52*b* of the barrel piece 52B of the shield crimping portion 50 are engaged with each other. Alternatively, the braid disintegration preventive band portion 81 may cover approximately the entire circumference of the shield layer 33.

With the above configuration, when the shield crimping portion 50 is crimped onto the shield layer 33 which is a braid, even if the shield layer 33 is disintegrated to some extent, the braid disintegration preventive band portion 81 prevents loose portions of the shield layer 33 from being deformed or moved and can thereby prevents an event that loose portions of the shield layer 33 go into the gap between the engagement portions including the engagement projection 52*a* of the barrel piece 52A and the engagement recess 52*b* of the barrel piece 52B.

The shielded connector 2 according to the second embodiment provides, in addition to the advantages of the shielded connector 1 according to the first embodiment, an advantage that the braid disintegration preventive band portion 81 prevents loose portions of the shield layer 33 from going into the gap between the engagement portions including the engagement projection 52*a* of the barrel piece 52A and the engagement recess 52*b* of the barrel piece 52B, and thereby prevents an event that loose portions of the shield layer 33 that go into the gap between the engagement portions including the engagement projection 52*a* of the barrel piece 52A and the engagement recess 52*b* of the barrel piece 52B weaken the strength of the engagement between the pair of barrel pieces 52A and 52B and the pair of barrel pieces 52A and 52B are disengaged from each other and opened at the occurrence of an external load on the shield crimping portion 50 as would be caused when the shielded cable 30 is pulled.

In the shielded connector 2 according to the second embodiment, before being bent so as to become parallel with the outer circumferential surface of the shield layer 33, the braid disintegration preventive band portion 81 projects from the link portion 40*a* parallel with the projection direction of the barrel pieces 52A and 52B in a developed state, that is, approximately perpendicularly to the extension direction of the shielded cable 30. Thus, the braid disintegration preventive band portion 81 can be bent so as to become parallel with the outer circumferential surface of the shield layer 33 in the same manner as the pair of barrel pieces 52A and 52B are crimped onto the shield layer 33. As a result, the braid disintegration preventive band portion 81 can be bent so as to become parallel with the outer circumferential surface of the shield layer 33 using the link portion 40*a* effectively without requiring a die or the like for bending it that has a complex shape.

In the shielded connectors 1 and 2 according to the first and second embodiments, the engagement projection 52*a* increases in width as the position goes from its base side to its tip side in the projection direction and the engagement recess 52*b* is shaped so as to conform to the engagement projection 52*a*. However, the invention is not limited to that case. The engagement projection 52*a* and the engagement recess 52*b* may have other shapes as long as they allow the end portions of the pair of barrel pieces 52A and 52B to engage with each other so that the shield crimping portion 50 assumes a true circle.

The characteristics of the embodiments of the shielded connector according to the present invention described above will be briefly summarized and listed in the following items [1] to [7].

[1] A shielded connector shielded connector including:

a shielded cable including:

a conductor;

an insulation cover that covers an outer circumferential surface of the conductor;

a shield layer that covers an outer circumferential surface of the insulation cover; and an outermost insulation cover that covers an outer circumferential surface of the shield layer, an inner terminal connected to the conductor; and an outer terminal that houses the inner terminal and includes a shield crimping portion which is crimped on the shield layer, wherein the shielded cable is a coaxial cable; and wherein the shield crimping portion includes a pair of barrel pieces having end portions formed with an engagement projection and an engagement recess, respectively, that are engaged with each other so that the shield crimping portion is crimped on an outer circumferential surface of an exposed portion of the shield layer exposed from the outermost insulation cover so as to be a substantially true circle in cross section.

[2] The outer terminal has an insulation cover crimping portion which is crimped on the outermost insulation cover at a position spaced from a position where the shield crimping portion is crimped on the outer circumferential surface of the exposed portion of the shield layer.

[3] The engagement projection increases in width as the position goes from its base side to its tip side in its projection direction, and the engagement recess is recessed so as to conform to the engagement projection and to fit with the engagement projection.

[4] The shield crimping portion has approximately U-shape before being crimped onto the shield layer, and the end portions, formed with the engagement projection and the engagement recess, of the pair of barrel pieces are bent inward, respectively.

[5] In the shield crimping portion, inner edges located on two respective sides of a base portion of the engagement projection are formed with respective engagement guide slant surfaces to guide for engagement between the engagement projection and the engagement recess, the engagement guide slant surfaces being inclined so that the barrel piece formed with the engagement projection becomes thinner as the position goes toward its tip.

[6] The shield layer is a braid, and the outer terminal has a band-shaped braid disintegration preventive band portion which is disposed in front of the shield crimping portion in an extension direction of the shielded cable, and covers the shield layer by extending parallel with its outer circumferential surface.

[7] The outer terminal has an outer terminal main body which houses the inner terminal and a link portion which links the outer terminal main body and the shield crimping portion; and that before being bent so as to become parallel with the outer circumferential surface of the shield layer, the braid disintegration preventive band portion projects from the link portion parallel with a projection direction of the pair of barrel pieces in a developed state and approximately perpendicularly to the extension direction of the shielded cable.

In the shielded connector recited in item [1], the shielded cable is a coaxial cable and the shield crimping portion is crimped on the outer circumferential surface of a portion, exposed by peeling off a corresponding portion of the outermost insulation cover, of the shielded cable by engaging the engagement projection and the engagement recess of the pair of barrel pieces. In this manner, the shield crimping portion can be crimped onto the shield layer which extends parallel with the circular outer circumferential surface of the insulation cover in such a manner that the shield crimping portion assumes a true circle because of the engagement between the engagement projection and the engagement recess. Thus, the radial distance between the conductor and the shield layer is made uniform, which prevents impedance disorder due to non-uniformity in the radial distance between the conductor and the shield layer.

In the shielded connector recited in item [2], since the shield crimping portion and the insulation cover crimping portion can be crimped so to be spaced from each other, crimping deformation of the insulation cover crimping portion does not affect the shield crimping portion. This is also a factor in allowing the shield crimping portion to be crimped onto the shield layer so as to assume a shape that is close to a true circle.

In the shielded connector recited in item [3], the width of the engagement projection varies in simple form and the engagement recess is formed so as to conform to the engagement projection. Thus, the engagement projection and the engagement recess can be engaged with each other easily and strongly.

In the shielded connector recited in item [4], before the shield crimping portion is crimped onto the shield layer, the shield crimping portion is approximately U-shaped and the portions formed with the engagement projection and the end portion formed with the engagement recess of the pair of barrel pieces are bent inward, respectively. Thus, at an initial stage of crimping, the end portions of the pair of barrel pieces can be made close to each other to establish a state that the shield crimping portion can be deformed so as to assume a circular shape. This makes it easier for the shield crimping portion to be crimped so as to assume a true circle.

In the shielded connector recited in item [5], since the shield crimping portion is formed with the engagement guide slant surfaces, in a process of crimping of the shield crimping portion onto the shield layer, the tip surfaces of the end portion formed with the engagement recess of the barrel piece are guided by the respective engagement guide slant surfaces while sliding thereon, whereby the engagement recess is registered with the engagement projection below it. In this manner, the shield crimping portion tends to be bent so as to assume a circular shape. This makes it easier for the shield crimping portion to be crimped so as to assume a true circle.

The shielded connector recited in item [6] provides, in addition to the advantages of the shielded connectors recited in items [1] to [5], an advantage that the braid disintegration preventive band portion prevents loose portions of the shield layer from going into the gap between the engagement portions including the engagement projection and the engagement recess of the pair of barrel pieces, and thereby prevents an event that loose portions of the shield layer that go into the gap between the engagement portions including the engagement projection and the engagement recess of the pair of barrel pieces weaken the strength of the engagement between the pair of barrel pieces and the pair of barrel pieces are disengaged from each other and opened at the occurrence of an external load on the shield crimping portion as would be caused when the shielded cable is pulled.

In the shielded connector recited in item [7], before being bent so as to become parallel with the outer circumferential surface of the shield layer, the braid disintegration preventive band portion projects from the link portion parallel with the projection direction of the pair of barrel pieces in a developed state, that is, approximately perpendicularly to the extension direction of the shielded cable. Thus, the braid disintegration preventive band portion can be bent so as to become parallel with the outer circumferential surface of the shield layer in the same manner as the pair of barrel pieces are crimped onto the shield layer. As a result, the braid disintegration preventive band portion can be bent so as to become parallel with the outer circumferential surface of the shield layer using the link portion effectively without requiring a die or the like for bending it that has a complex shape.

Although the invention made by the present inventor has been described above in a specific manner in the form of the embodiments, the invention should not be construed as being limited to the embodiments. Various modifications are possible without departing from the spirit and scope of the invention.

What is claimed is:

1. A shielded connector comprising:

a shielded cable comprising:

a conductor;

an insulation cover that covers an outer circumferential surface of the conductor;

a shield layer that covers an outer circumferential surface of the insulation cover; and an outermost insulation cover that covers an outer circumferential surface of the shield layer, an inner terminal connected to the conductor; and an outer terminal that houses the inner terminal and comprises a shield crimping portion which is crimped on the shield layer, wherein the shielded cable is a coaxial cable;

wherein the shield crimping portion comprises a pair of barrel pieces having end portions formed with an engagement projection and an engagement recess, respectively, that are engaged with each other so that the shield crimping portion is crimped on an outer circumferential surface of an exposed portion of the shield layer exposed from the outermost insulation cover so as to be a substantially true circle in cross section; and wherein each of the barrel pieces has an inner surface that abuts the shield layer, and the inner surfaces have asperities.

2. The shielded connector according to claim 1, wherein the outer terminal comprises an insulation cover crimping portion which is crimped on the outermost insulation cover at a position spaced from another position where the shield crimping portion is crimped on the outer circumferential surface of the exposed portion of the shield layer.

3. The shielded connector according to claim 1, wherein the engagement projection increases in width as the position goes from a base side to a tip side in a projection direction of the engagement projection; and wherein the engagement recess is recessed so as to conform to the engagement projection and to fit with the engagement projection.

4. The shielded connector according to claim 1, wherein the shield crimping portion has approximately U-shape before being crimped onto the shield layer, and the end portions, formed with the engagement projection and the engagement recess, of the pair of barrel pieces are bent inward, respectively.

5. The shielded connector according to claim 4, wherein in the shield crimping portion, inner edges located on two respective sides of a base portion of the engagement projection are formed with respective engagement guide slant surfaces to guide for engagement between the engagement projection and the engagement recess, the engagement guide slant surfaces being inclined so that the barrel piece formed with the engagement projection becomes thinner as the position goes toward its tip.

6. The shielded connector according to claim 1, wherein the shield layer is a braid; and wherein the outer terminal comprises a band-shaped braid disintegration preventive band portion which is disposed in front of the shield crimping portion in an extension direction of the shielded cable, and covers the shield layer by extending parallel with its outer circumferential surface.

7. The shielded connector according to claim 6, wherein the outer terminal comprises:

an outer terminal main body which houses the inner terminal; and a link portion which links the outer terminal main body and the shield crimping portion; and wherein before being bent so as to become parallel with the outer circumferential surface of the shield layer, the braid disintegration preventive band portion projects from the link portion parallel with a projection direction of the pair of barrel pieces in a developed state and approximately perpendicularly to the extension direction of the shielded cable.

* * * * *